US007064100B2

(12) United States Patent
Assmann et al.

(10) Patent No.: US 7,064,100 B2
(45) Date of Patent: Jun. 20, 2006

(54) METHOD FOR PRODUCING BLEACH ACTIVATOR GRANULES

(75) Inventors: Georg Assmann, Jüchen (DE); Olaf Joachim Blochwitz, Genthin (DE); Horst-Dieter Speckmann, Langenfeld (DE); Jörg Poethkow, Neuss (DE); Birgit Middelhauve, Monheim (DE); Gerhard Blasey, Düsseldorf (DE)

(73) Assignee: Henkel Komanditgesellschaft auf Aktien (Henkel Kgaa), Duesseldorf (DE)

( * ) Notice: Subject to any disclaimer, the term of this patent is extended or adjusted under 35 U.S.C. 154(b) by 0 days.

(21) Appl. No.: 10/861,342

(22) Filed: Jun. 4, 2004

(65) Prior Publication Data

US 2004/0248755 A1 Dec. 9, 2004

Related U.S. Application Data

(63) Continuation of application No. PCT/EP02/13126, filed on Nov. 22, 2002.

(30) Foreign Application Priority Data

Dec. 4, 2001 (DE) ..... 101 59 386

(51) Int. Cl.
*C11D 1/62* (2006.01)
*C11D 3/26* (2006.01)
*C11D 11/00* (2006.01)

(52) U.S. Cl. ..... 510/445; 510/302; 510/303; 510/314; 510/376; 510/441; 510/504

(58) Field of Classification Search ..... 510/302, 510/303, 314, 376, 441, 445, 504
See application file for complete search history.

(56) References Cited

U.S. PATENT DOCUMENTS 5,516,447 A 5/1996 Bauer et al.
5,814,242 A * 9/1998 Alvarez et al. ..... 252/186.39
5,888,419 A * 3/1999 Casella et al. ..... 252/186.39
6,063,750 A * 5/2000 Loffler et al. ..... 510/444
6,133,216 A * 10/2000 Loffler et al. ..... 510/349
6,214,785 B1 4/2001 Himmrich et al.
6,221,824 B1 4/2001 Lietzmann et al.
6,225,274 B1 5/2001 Nitsch et al.
6,362,157 B1 3/2002 Blochwitz et al.

FOREIGN PATENT DOCUMENTS

| | | | |
|---|---|---|---|
| CA | 2 299 437 | A1 | 8/2000 |
| DE | 41 29 074 | A1 | 3/1993 |
| DE | 197 50 424 | A1 | 5/1999 |
| DE | 199 08 069 | A1 | 8/2000 |
| EP | 0 464 880 | B1 | 12/1994 |
| EP | 0 603 207 | B1 | 5/1995 |
| EP | 0 985 728 | A1 | 3/2000 |
| WO | WO 98/23531 | A1 | 6/1998 |
| WO | WO 98/23719 | A2 | 6/1998 |
| WO | WO 00/50556 | A1 | 8/2000 |
| WO | WO02/12175 | * | 2/2002 |

OTHER PUBLICATIONS

U.S. Appl. No. 10/861,188, Assmann et al.
Abraham, "Solvent Effects on Transition States and Reaction Rates", Progr. Phys. Org. Chem vol. 11, pp. 1-87 (1974).
Arnett et al., "Electronic Effects on the Menschutkin Reaction. A Complete Kinetic and Thermo dynamic Dissection of Alkyl Transfer to 3- and 4- Substituted Pyridines", J. Am. Chem. Soc., vol. 102, pp. 5892-5902 (1980).
PCT/EP02/13126 Search Report dated Apr. 25, 2003.

* cited by examiner

*Primary Examiner*—Gregory R. Del Cotto
(74) *Attorney, Agent, or Firm*—Woodcock Washburn LLP

(57) ABSTRACT

The present invention relates to methods for producing bleach-activator-containing granules from a water-containing bleach activator preparation form by granulation and simultaneous drying in a fluidized-bed and subsequent consolidation of the primary granules by treatment with an aqueous polymer and/or phosphonate solution, in a fluidized bed.

29 Claims, No Drawings

METHOD FOR PRODUCING BLEACH ACTIVATOR GRANULES

CROSS REFERENCE TO RELATED APPLICATIONS

This application is a continuation of PCT/EP02/13126 filed Nov. 22, 2002, which claims the benefit of DE 101 59 386.4 filed Dec. 4, 2001, the complete disclosures of which are hereby incorporated by reference in their entirety.

FIELD OF THE INVENTION

The invention relates to a method for producing bleach-activator-containing granules from a water-containing bleach activator preparation form by granulation and simultaneous drying in a fluidized-bed and subsequent consolidation of the primary granules by treatment with an aqueous polymer and/or phosphonate solution, likewise in a fluidized bed.

BACKGROUND OF THE INVENTION

As well as comprising ingredients which are indispensable for the washing process, such as surfactants and builder materials, detergents and cleaners usually comprise further constituents which can be summarized under the term washing auxiliaries and include various groups of active ingredients, such as foam regulators, graying inhibitors, bleaches and color transfer inhibitors. Such auxiliaries also include substances which aid the surfactant performance as a result of oxidative degradation of soilings located on the textile or those in the liquor. Analogous statements also apply to cleaners for hard surfaces. For example, inorganic peroxygen compounds, in particular hydrogen peroxide and solid peroxygen compounds which dissolve in water to liberate hydrogen peroxide, such as sodium perborate and sodium carbonate perhydrate, have been used for a long time as oxidizing agents for disinfection and bleaching purposes. The oxidative effect of these substances greatly depends on the temperature in dilute solutions; thus, for example, with $H_2O_2$ or sodium perborate in alkaline bleaching liquors, sufficiently rapid bleaching of soiled textiles usually only takes place at temperatures above about 60° C. At lower temperatures it is possible to improve the oxidative effect of the inorganic peroxygen compounds by adding so-called bleach activators, for which numerous proposals, primarily from the classes of substance of N- or O-acyl compounds, for example polyacylated alkylenediamines, in particular tetraacetylethylenediamine, acylated glycolurils, in particular tetraacetylglycoluril, N-acylated hydantoins, hydrazides, triazoles, hydrotriazines, urazoles, diketopiperazines, sulfurylamides and cyanurates, and also carboxylic anhydrides, in particular phthalic anhydride, carboxylic esters, in particular sodium nonanoyloxybenzenesulfonate, sodium isononanoyloxybenzenesulfonate and acylated sugar derivatives, such as pentaacetylglucose, have become known in the literature. The addition of these substances can increase the bleaching action of aqueous peroxide liquors such that even at temperatures below 60° C. essentially the same effects arise as with the peroxide liquor on its own at 95° C.

European patent application EP 0 464 880 discloses bleach-boosting cationic nitriles of the general formula R'R" R'" $N^+$—$CR_1R_2$—CN $X^-$, in which $R_1$ and $R_2$ are hydrogen or a substituent with at least one carbon atom, R' is a ($C_1$–$C_{24}$)-alkyl, -alkenyl or -alkyl ether group or —$CR_1R_2$—CN, and R" and R'" are each case ($C_1$–$C_{24}$)-alkyl or hydroxyalkyl group, and the counteranion $X^-$ is an organic sulfonate, an organic sulfate or a carboxylate.

International patent application WO 98/23719 discloses that compounds of the general formula $R^1R^2R^3N^+CH_2CN$ $X^-$, in which $R^1$, $R^2$ and $R^3$, are independently alkyl, alkenyl or aryl group having 1 to 18 carbon atoms, where the groups $R^2$ and $R^3$ may also be part of a heterocycle including the N atom and optionally containing further heteroatoms, and $X^-$ is a charge-balancing anion, can be used as activators for, in particular, inorganic peroxygen compounds in aqueous dish-washing solutions. This provides an improvement of the oxidative and bleaching effect in particular of inorganic peroxygen compounds at low temperatures below 80° C., in particular in the temperature range from about 15° C. to 55° C. At least some of these cationic nitriles, however, are produced in the course of their production in liquid form, for example as in particular aqueous solution, and can only be converted from these into the pure solid with considerable losses, meaning that their use in solid, for example particulate, compositions presents difficulties. In addition, cationic nitriles, particularly in combination with further ingredients of detergents and cleaners, are normally not very storage-stable and in particular sensitive to moisture.

International patent application WO 00/50556 discloses the production of solid preparations which comprise cationic nitrile and solid carrier material by a vacuum steam-drying method in a mixer. Although this method produces bleach activator granules, attempts are nevertheless made to develop an alternative production method which is as simple as possible.

SUMMARY OF THE INVENTION

An object of the invention was therefore to provide a production method with which aqueous preparations comprising a cationic nitrile can be converted into particulate preparations such that the bleach-activating active substance of the cationic nitrile can be incorporated into solid detergents and cleaners as far as possible without loss. It has now been found that the production of such preparations is possible by a fluidized-bed granulation method. In this method, drying and granulation can be carried out in a simple manner in one device, with the production of granules with a particularly high content of cationic nitrile being readily possible These and other aspects of the invention will become more apparent from the detailed description and claims.

DETAILED DESCRIPTION OF THE INVENTION

In one embodiment, the present invention provides methods for producing a particulate preparation comprising a compound according to formula (I),

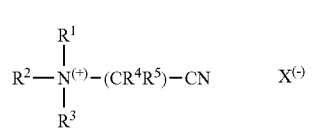

(I)

wherein:

$R^1$ is —H, —$CH_3$, optionally substituted ($C_2$–$C_{24}$)-alkyl radical, optionally substituted ($C_2$–$C_{24}$)-alkenyl radical, optionally substituted alkyl radical containing a ($C_1$–$C_{24}$- alkyl group, or optionally substituted alkenylaryl radical containing a ($C_1$–$C_{24}$)-alkyl group;

$R^2$ and $R^3$ are independently —$CH_2$—CN, —$CH_3$, —$CH_2$—$CH_3$, —$CH_2$—$CH_2$–$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, or —($CH_2CH_2$—O)$_n$H;

$R^4$ and $R^5$ are independently —H, —$CH_3$, optionally substituted ($C_2$–$C_{24}$)-alkyl radical, optionally substituted ($C_2$–$C_{24}$)-alkenyl radical, optionally substituted alkyl radical containing a ($C_1$–$C_{24}$)-alkyl group, optionally substituted alkenylaryl radical containing a ($C_1$–$C_{24}$)-alkyl group, —$CH_2$—CN, —$CH_2$—$CH_3$, —$CH_2$—$CH_2$–$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, or —($CH_2CH_2$—O)$_n$ H;

n is an integer of 1, 2, 3, 4, 5 or 6;

$X^{(-)}$ is a charge-balancing anion, wherein said particulate is produced by the steps:

a) preparation of an aqueous solution comprising cationic nitrile of formula (I) and optionally alkali metal cumenesulfonate, in particular sodium cumenesulfonate, b) optional adjustment of the solution to an acidic pH, in particular by adding sulfuric acid and/or citric acid, c) atomization and drying of the solution in a fluidized-bed apparatus, d) optional powdering of the resulting primary granules using silica, zeolite and/or Na cumenesulfonate in the fluidized bed, e) consolidation of the optionally powdered primary granules by subsequent spraying with an aqueous consolidation solution, said solution comprising polymeric polycarboxylate and/or alkali metal phosphonate as consolidation active ingredient, with simultaneous drying in the same or optionally a downstream second fluidized-bed apparatus, f) discharge of the granules from the fluidized-bed apparatus and optional separation of the granules into acceptable granules and coarse/fine granules, in particular by sieving, g) optional return of fine granules and/or ground coarse granules into the fluidized bed in step c), and h) optional return of fine granules and/or ground coarse granules into the powdering step d).

In another embodiment, the present invention provides methods producing a particulate preparation comprising:

providing an aqueous solution comprising a cationic nitrile of formula (I):

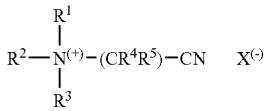

I wherein:

$R^1$ is —H, —$CH_3$, optionally substituted ($C_2$–$C_{24}$)-alkyl radical, optionally substituted ($C_2$–$C_{24}$)-alkenyl radical, optionally substituted alkyl radical containing a ($C_1$–$C_{24}$)-alkyl group, or optionally substituted alkenylaryl radical containing a ($C_1$–$C_{24}$)-alkyl group;

$R^2$ and $R^3$ are independently —$CH_2$—CN, —$CH_3$, —$CH_2$—$CH_3$, —$CH_2$—$CH_2$–$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, or —($CH_2CH_2$—O)$_n$H, wherein n is an integer of 1, 2, 3, 4, 5 or 6;

$R_4$ and $R_5$ are independently R1 or R2; and $X^{(-)}$ is a charge-balancing anion;

atomizing and drying the solution in a fluidized-bed apparatus to form primary granules;

consolidating the granules by subsequent spraying with an aqueous consolidation solution with simultaneous drying; and discharging the granules from the fluidized-bed apparatus.

The terms "optionally substituted ($C_2$–$C_{24}$)-alkyl" or "optionally substituted ($C_2$–$C_{24}$)— alkenyl radical", as used herein, includes those alkyl or alkenyl radicals that are optionally substituted with at least one substituent selected from the group comprising —Cl, —Br, —OH, —NH2, and —CN.

The term "optionally substituted alkenylaryl radical", as used herein, includes those alkenylaryl radicals that are optionally substituted with a ($C_1$–$C_{24}$)-alkyl group and which further contain at least one substitutent on the aromatic ring.

The resulting bleach activator granules or the acceptable granule fraction thereof preferably has/have average particle diameters in the range from 0.2 mm to 2.5 mm, in particular in the range from 0.4 mm to 2.0 mm. Its bulk density is preferably in the range from 300 g/l to 1000 g/l, in particular in the range from 400 g/l to 800 g/l. The proportion of compound according to formula (I) is preferably in the range from 10% by weight to 90% by weight, in particular from 15% by weight to 50% by weight. It is preferably used for producing particulate detergents or cleaners.

The method according to the invention preferably starts from an aqueous solution of the compound according to formula (I), as is produced in its preparation. In this, the concentration of compound according to formula (I) is preferably 10% by weight to 90% by weight, in particular from 15% by weight to 50% by weight. It is optionally mixed with alkali metal cumenesulfonate, which can be used in the form of a solid or in the form of an aqueous solution and is preferably used in quantitative ratios (compound according to formula (I) to alkali metal cumenesulfonate) of from 10:1 to 1:5, in particular from 2:1 to 1:2, the pH is adjusted to an acidic value, where one is not already present, by adding system-compatible acid, for example sulfuric acid and/or citric acid, and the solution is sprayed in a fluidized-bed apparatus above an inflow base provided with openings for the fluidizing gas, in particular fluidizing air, as a result of which water is removed from it and granules form. Fluidized-bed devices which can be used in a method according to the invention are known, for example, from European patent specification EP 0 603 207 B 1 or German patent application DE 197 50 424. In order to further reduce the possibility of the granules falling through the openings in the inflow base, which would result in them coming into contact with surfaces at a relatively high temperature, the openings can be covered by a grid, in particular with mesh widths less than 600 μm. Here, the grid may be arranged within or above the openings. However, the grid is preferably directly below the openings in the inflow base, as is known in principle from German patent application DE 197 50 424. In one practical variant, a metal gauze with an appropriate mesh width can be sintered, or attached in some other way, to the underside of an inflow base known per se. The metal gauze preferably consists of the same material as the inflow base, in particular of stainless steel. The fine-mesh grid prevents particles from falling through, particularly when the granulation plant is shut down unexpectedly, but also especially in the case of particularly heavy particles with bulk densities around 1000 g/l also during operation. The mesh width of said grid is preferably between 200 and 400 μm. In addition, it is advantageous if the inflow base used has a pressure loss of at most 10 mbar and in particular at most 6 mbar.

In order to improve the pourability of the resulting primary granules, they may then be powdered in the granulation step with finely divided material chosen from silica, zeolite and/or Na cumenesulfonate.

The optionally powdered primary granules are then optionally transferred to a second fluidized-bed apparatus ("consolidation apparatus"), which may be of identical construction to the fluidized-bed apparatus used above, and are sprayed with an aqueous consolidation solution. Suitable consolidation active ingredients are polymeric polycarboxylates, in particular polymerization products of acrylic acid, methacrylic acid or maleic acid, or copolymers of at least two of these, which are used in completely or at least partially neutralized form, in particular in the form of the alkali metal salts. Alkali metal phosphonate can be used as an alternative to or in addition to the polymeric polycarboxylate. In said alkali metal salts, sodium is the alkali metal preferred in each case. The consolidation liquid is preferably adjusted to the lowest possible viscosity for good drop distribution upon atomization in the consolidation apparatus with simultaneous drying.

Finally, the granules are discharged from the fluidized bed in a manner known in principle and optionally classified according to particle size, where undesirably small particles (fine granules) and undesirably large particles (coarse granules) can be returned to the process following a grinding step. If desired, they can be returned to the granulation step or to the powdering step or to both steps. In one particular variant of the method according to the invention, the classified acceptable granules can again be introduced into a fluidized-bed apparatus, and consolidation solution be sprayed onto them in order, if necessary, to further improve the product properties of the granules.

Compounds according to formula I can be produced by known processes or in accordance with these, as have been published, for example, in said patent literature or by Abraham in Progr. Phys. Org. Chem. 11 (1974), p. 1 ff, or by Arnett in J. Am. Chem. Soc. 102 (1980), p. 5892 ff.

Preference is given to the use of compounds according to formula I in which $R^1$, $R^2$ and $R^3$ are identical. Of these, preference is given to those compounds in which said radicals are methyl groups. On the other hand, preference is also given to those compounds in which at least 1 or 2 of said radicals are methyl groups and the other radical, or the other radicals, have two or more carbon atoms.

The anions $X^{(-)}$ include, in particular, the halides, such as chloride, fluoride, iodide and bromide, nitrate, hydroxide, phosphate, hydrogenphosphate, dihydrogenphosphate, pyrophosphate, metaphosphate, hexafluorophosphate, carbonate, hydrogencarbonate, sulfate, hydrogensulfate, $C_{1-20}$-alkyl sulfate, $C_{1-20}$-alkylsulfonate, optionally $C_{1-18}$-alkyl-substituted aryl-sulfonate, chlorate, perchlorate and/or the anions of $C_{1-24}$-carboxylic acids, such as formate, acetate, laurate, benzoate or citrate, alone or in any mixtures. Preference is given to compounds according to formula I in which $X^{(-)}$ is chloride, sulfate, hydrogensulfate, ethosulfate, $C_{12/18}$-, $C_{12/16}$- or $C_{13/15}$-alkyl sulfate, lauryl sulfate, dodecylbenzenesulfonate, toluenesulfonate, cumenesulfonate, xylenesulfonate or methosulfate or mixtures thereof. Toluenesulfonate, or cumenesulfonate, is understood here as meaning the anion of the ortho-, meta- or para-isomers of methylbenzenesulfonic acid, or isopropylbenzenesulfonic acid, respectively, and any mixtures thereof. para-Isopropylbenzenesulfonic acid is particularly preferred.

Granules produced by the method according to the invention are storage-stable, readily pourable and of adequate granule stability in order to permit them to be mixed with other particulate constituents of detergents or cleaners in a customary manner. The bleach-activating effect of the compound according to formula (I) is not significantly impaired by the method. Granules prepared by the method according to the invention are used in particular in particulate detergents and cleaners, preferably in amounts such that these compositions have contents of from 0.1% by weight to 10% by weight, in particular from 0.2% by weight to 7% by weight, of bleach activator according to formula (I).

EXAMPLES

Example 1

Granules were prepared in a fluidized-bed apparatus (Glatt® AGT 400 with a diameter of 40 cm) with 400 $m^3$/h of incoming air stream, an incoming air temperature of 95° C. and an outgoing air temperature of 55° C. from a homogeneous aqueous solution of trimethylammonium acetonitrile methosulfate and sodium cumenesulfonate (mass ratio 1:1, dry-substance fraction 30%) at a solution throughput of 3 kg/h over the course of 5 h; the granules were still very tacky. The tackiness was overcome by granulating again with a 20% strength aqueous solution of polymeric polycarboxylate (Sokalan® CP45, manufacturer BASF) under the same conditions with regard to incoming air stream, incoming air temperature and outgoing air temperature. The polymer fraction in the granules obtained in this way was 5% by weight. The size of the granules was in the range from 0.4 mm to 2.0 mm, the bulk density was 700 g/l. The granules were then sieved and the proportion with granule sizes of between 0.8 and 1.6 mm was mixed with the other detergent components of a detergent formulation. The finished detergent could be used without clumping.

Example 2

In a fluidized-bed apparatus with a diameter of 1.8 m (Glatt® AGT 1800), primary granules were prepared from a 40% strength aqueous solution of the cationic nitrile used in example 1, with powdering with Na cumenesulfonate powder. The amount of incoming air was 21 000 $m^3$/h, the incoming air temperature was 145° C. The outgoing air temperature was adjusted to 65° C. by evaporating the water in this solution. After 1 h, the batch-operated fluidized bed was so full that the granulation was stopped. The consolidation was carried out using the 20% strength polymer solution used in example 1 at an incoming air temperature of 110° C. The polymer content in the finished granules was 10% by weight. The resulting granules were sieved off between 0.8 and 1.6 mm. The bulk density was 730 g/l.

The finished granules were processed with customary particulate detergent components to give a particulate detergent.

Example 3

In a fluidized-bed apparatus with a diameter of 1.8 m (Glatt® AGT 1800), primary granules were prepared from a 40% strength aqueous solution of the cationic nitrile used in Example 1, with powdering with silica powder (Thixosil® 38A). The amount of incoming air was 20 000 $m^3$/h, the incoming air temperature was 140° C. The outgoing air temperature was adjusted to 65° C. by evaporating the water in this solution. After 1 h, the batch-operated fluidized bed was so full that the granulation was stopped. The consolidation was carried out using the 20% strength polymer solution used in example 1 at an incoming air temperature of 110° C. The polymer content in the finished granules was 7% by weight. The resulting granules were sieved off between 0.8 and 1.6 mm. The bulk density was 710 g/l.

Example 4

The granules obtained according to example 2 were introduced again into the fluidized-bed apparatus, where they were sprayed from the side with the 20% strength polymer solution already used above at an incoming air temperature of 130° C. and an outgoing air temperature of 65° C. to give a 20% by weight coating. Similarly, the granules obtained according to example 3 were again introduced into the fluidized-bed apparatus where they were sprayed from the side with the 20% strength polymer solution at an incoming air temperature of 130° C. and an outgoing air temperature of 65° C. to give a 10% by weight coating.

The disclosures of each patent, patent application, and publication cited or described in this document are hereby incorporated herein by reference, in their entireties.

Various modifications of the invention, in addition to those described herein, will be apparent to those skilled in the art from the foregoing description. Such modifications are also intended to fall within the scope of the appended claims.

What is claimed is:

1. A method for producing a particulate preparation comprising a compound according to formula (I):

I

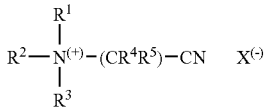

wherein:

$R^1$ is —H, —$CH_3$, optionally substituted ($C_2$–$C_{24}$)-alkyl radical, optionally substituted ($C_2$–$C_{24}$)-alkenyl radical, optionally substituted alkyl radical containing a ($C_1$–$C_{24}$)-alkyl group, or optionally substituted alkenylaryl radical containing a ($C_1$–$C_{24}$)-alkyl group;

$R^2$ and $R^3$ are independently —$CH_2$—CN, —$CH_3$, —$CH_2$—$CH_3$, —$CH_2$—$CH_2$–$CH_3$, —CH($CH_3$)—$CH_3$, —$CH_2$—OH, —$CH_2$—$CH_2$—OH, —CH(OH)—$CH_3$, —$CH_2$—$CH_2$–$CH_2$—OH, —$CH_2$—CH(OH)—$CH_3$, —CH(OH)—$CH_2$—$CH_3$, or —($CH_2CH_2$—O)$_n$H;

$R_4$ and $R_5$ are independently —H, —$CH_3$, optionally substituted ($C_2$–$C_{24}$)-alkyl radical, optionally substituted ($C_2$–$C_{24}$)-alkenyl radical, optionally substituted alkyl radical containing a ($C_1$–$C_{24}$)-alkyl group, optionally substituted alkenylaryl radical containing a ($C_1$–$C_{24}$)-alkyl group, —$CH_2$—CN, —$CH_2$—$CH_3$, —$CH_2$—$CH_2$–$CH_3$, —CH($CH_3$)—$CH_3$, —$CH_2$—OH, —$CH_2$—$CH_2$—OH, —CH(OH)—$CH_3$, —$CH_2$—$CH_2$—OH, —$CH_2$—CH(OH)—$CH_3$, —CH(OH)—$CH_2$—$CH_3$, or —($CH_2CH_2$—O)$_n$H;

n is an integer of 1, 2, 3, 4, 5 or 6;

$X^{(-)}$ is a charge-balancing anion;

said particulate produced by the steps:

a) preparation of an aqueous solution comprising cationic nitrile of formula (I) and optionally alkali metal cumenesulfonate;

b) optional adjustment of the solution to an acidic pH;

c) atomization and drying of the solution in a fluidized-bed apparatus;

d) optional powdering of the resulting primary granules in the fluidized bed;

e) consolidation of the optionally powdered primary granules by subsequent spraying with an aqueous consolidation solution, with simultaneous drying in the same or optionally a downstream second fluidized-bed apparatus;

f) discharge of the granules from the fluidized-bed apparatus and optional separation of the granules into acceptable granules and coarse/fine granules;

g) optional return of the fine granules and/or the ground coarse granules into the fluidized bed in step c); and h) optional return of the fine granules and/or the ground coarse granules into the powdering step of step d).

2. The method of claim 1, wherein the concentration of said compound of formula (I) is from about 10% by weight of said aqueous solution to about 90% by weight of said aqueous solution.

3. The method of claim 1, wherein the concentration of said compound of formula (I) is from about 15% by weight of said aqueous solution to about 50% by weight of said aqueous solution.

4. The method of claim 1, wherein said compound of formula (I) and said alkali metal cumenesulfonate are present in a ratio of from about 10:1 compound of formula (I):alkali metal cumenesulfonate, to about 1:5 compound of formula (I):alkali metal cumenesulfonate.

5. The method of claim 1, wherein said compound of formula (I) and said alkali metal cumenesulfonate are present in a ratio of from about 2:1 compound of formula (I):alkali metal cumenesulfonate, to about 1:2 compound of formula (I):alkali metal cumenesulfonate.

6. The method of claim 1, wherein said alkali metal cumenesulfonate is sodium cumenesulfonate.

7. The method of claim 1, wherein said acidic pH is adjusted by the addition of sulfuric acid, citric acid, or combinations thereof.

8. The method of claim 1, wherein said primary granules are powdered with silica, zeolite, Na cumenesulfonate, or combinations thereof.

9. The method of claim 1, wherein said aqueous consolidation solution comprises polymeric polycarboxylate, alkali metal phosphonate, or combinations thereof as the consolidation active ingredient.

10. The method of claim 9, wherein said polymeric polycarboxylate is polymerization products of acrylic acid, methacrylic acid, maleic acid, copolymers of at least two the polymerization products, in at least partially neutralized form.

11. The method of claim 10, wherein said copolymers are in the form of alkali metal salts.

12. The method of claim 11, wherein said alkali metal salt is sodium.

13. The method of claim 1, wherein said separation of the granules is by sieving.

14. The method of claim 1, wherein said $R_1$, $R^2$ and $R^3$ are the same.

15. The method of claim 1, wherein said $R^1$, $R^2$, and $R^3$ are $—CH_3$.

16. The method of claim 1, wherein 1 or 2 of said $R^1$, $R^2$ and $R^3$ radicals are $—CH_3$ and at least one of said $R^1$, $R^2$ and $R^3$ radicals contains 2 or more carbon atoms.

17. The method of claim 1, wherein said $X^{(-)}$ is halide, nitrate, hydroxide, phosphate, hydrogen phosphate, dihydrogen phosphate, pyrophosphate, metaphosphate, hexafluorophosphate, carbonate, hydrogencarbonate, sulfate, hydrogensulfate, $(C_1–C_{20})$-alkyl sulfate, $(C_1–C_{20})$-alkylsulfonate, optionally substituted $(C_1–C_{18})$-alkyl arylsulfonate, chlorate, perchlorate, an anion of $(C_1–C_{24})$-carboxylic acid, or combinations thereof.

18. The method of claim 1, wherein said $X^{(-)}$ is chloride, sulfate, hydrogen sulfate, methosulfate, ethosulfate, $(C_{12}–C_{18})$-alkyl sulfate, $(C_{12}–C_{16})$-alkyl sulfate, $(C_{13}–C_{15})$-alkyl sulfate, lauryl sulfate, dodecylbenzenesulfonate, toluenesulfonate, cumene-sulfonate, xylenesulfonate, para-isopropylbenzenesulfonic acid, or combinations thereof.

19. The method of claim 1, wherein said particulate preparation has an average particle diameter in a range of from about 0.2 mm to about 2.5 mm.

20. The method of claim 1, wherein particulate preparation has an average particle diameter in a range of from about 0.4 mm to about 2.0 mm.

21. The method of claim 1, wherein the bulk density of the particulate preparation is in a range of from about 300 g/l to 1000 g/l.

22. The method of claim 1, wherein the bulk density of the particulate preparation in a range of from about 400 g/l to about 800 g/l.

23. A method for producing a particulate preparation comprising:

providing an aqueous solution comprising a cationic nitrile of formula (I):

I

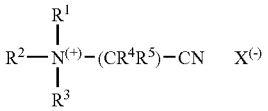

wherein:

$R^1$ is —H, $—CH_3$, optionally substituted $(C_2–C_{24})$-alkyl radical, optionally substituted $(C_2–C_{24})$-alkenyl radical, optionally substituted alkyl radical containing a $(C_1–C_{24})$-alkyl group, or optionally substituted alkenylaryl radical containing a $(C_1–C_{24})$-alkyl group;

$R^2$ and $R^3$ are independently $—CH_2—CN$, $—CH_3$, $—CH_2—CH_3$, $—CH_2—CH_2–CH_3$, $—CH(CH_3)—CH_3$, $—CH_2—OH$, $—CH_2—CH_2—OH$, $—CH(OH)—CH_3$, $—CH_2—CH_2–CH_2—OH$, $—CH_2—CH(OH)—CH_3$, $—CH(OH)—CH_2—CH_3$, or $—(CH_2CH_2—O)_n$ H, wherein n is an integer of 1, 2, 3, 4, 5 or 6;

$R_4$ and $R_5$ are independently R1 or R2; and $X^{(-)}$ is a charge-balancing anion;

atomizing and drying the solution in a fluidized-bed apparatus to form primary granules;

consolidating the granules by subsequent spraying with an aqueous consolidation solution with simultaneous drying; and discharging the granules from the fluidized-bed apparatus.

24. The method of claim 23 further comprising providing alkali metal cumenesulfonate in the aqueous solution.

25. The method of claim 23 further comprising adjusting the aqueous solution to an acidic pH.

26. The method of claim 23 further comprising powdering of the primary granules in the fluidized bed.

27. The method of claim 23 wherein consolidation takes place in a downstream second fluidized-bed apparatus.

28. The method of claim 23 further comprising separating the granules into acceptable granules and coarse/fine granules.

29. The method of claim 23 further comprising returning the fine granules and/or the ground coarse granules to the step of atomizing and drying.

* * * * *